US007427956B2

(12) United States Patent
Liao

(10) Patent No.: US 7,427,956 B2
(45) Date of Patent: Sep. 23, 2008

(54) ANTENNA STRUCTURE

(75) Inventor: Yen-Jang Liao, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 11/563,543

(22) Filed: Nov. 27, 2006

(65) Prior Publication Data

US 2008/0122720 A1 May 29, 2008

(51) Int. Cl.
*H01Q 1/24* (2006.01)
*H01Q 1/38* (2006.01)

(52) U.S. Cl. ..... 343/700 MS; 343/702

(58) Field of Classification Search ..... 343/700 MS, 343/702
See application file for complete search history.

(56) References Cited

U.S. PATENT DOCUMENTS 6,297,779 B1 10/2001 Tsai
6,380,898 B1 4/2002 Moore et al.
7,034,754 B2 * 4/2006 Hung et al. ..... 343/700 MS
7,136,025 B2 * 11/2006 Lin et al. ..... 343/770
7,148,849 B2 * 12/2006 Lin ..... 343/700 MS
7,289,071 B2 * 10/2007 Hung et al. ..... 343/702
7,292,194 B2 * 11/2007 Tai et al. ..... 343/702
2004/0090375 A1 * 5/2004 Dai et al. ..... 343/700 MS
2004/0090378 A1 * 5/2004 Dai et al. ..... 343/700 MS
2007/0040750 A1 * 2/2007 Tai et al. ..... 343/700 MS
2007/0085745 A1 * 4/2007 Su et al. ..... 343/700 MS
2007/0109200 A1 * 5/2007 Su ..... 343/700 MS

FOREIGN PATENT DOCUMENTS

TW M256178 2/2005
TW M276330 9/2005
TW M283340 12/2005

* cited by examiner

*Primary Examiner*—Trinh V Dinh
(74) *Attorney, Agent, or Firm*—J.C. Patents

(57) ABSTRACT

An antenna structure is suitable for being embedded in an electronic device. The antenna structure includes a grounding plate, a radiating plate, and a shorting plate. The grounding plate has a body and a bending portion extending from the body. The radiating plate is disposed above the grounding plate and is extended with an auxiliary radiating plate. The gap between the bending portion and the radiating plate is less than that between the body and the radiating plate. In addition, one end of the shorting plate is connected to the grounding plate, and the other end of the shorting plate is connected to the radiating plate.

14 Claims, 4 Drawing Sheets

ANTENNA STRUCTURE

BACKGROUND OF THE INVENTION

1. Field of the Invention

The present invention relates to an antenna structure, and more particularly, to an antenna structure that is suitable for being embedded in an electronic device.

2. Description of Related Art

With the rapid the development of wireless communication technology, a lot of electronic products with the wireless communication function are currently sold on the market. Most of these electronic products, such as mobile phones and notebook computers, employ the wireless communication technology for information transmission. As for communication products, the most crucial point is the design of an antenna, because the design and fabricating quality of the antenna will influence the quality of communication.

In view of the above, mobile phones and notebook computers have become indispensable electronic products in our daily life. Therefore, an antenna is usually embedded into a notebook computer to receive/send a mobile phone signal, so as to enhance the notebook computer functions. For example, in the prior art, the size of the antenna for the mobile phone is 110 mm×5 mm×6 mm, and the frequency range for the antenna of the mobile phone to receive/send signals is 900 MHz, 1800 MHz, and 1900 MHz.

However, all notebook computers on the current market are designed to follow the trend of being light and thin and tiny. Therefore, how to reduce the size of the antenna to fit in the limited space within the notebook computer becomes an important topic.

Furthermore, the antenna with a reduced size or a changed structure usually cannot maintain its original frequency range for receiving/sending signals. That is, the frequency range for the antenna to receive/send signals is not consistent with that of the mobile phone. Therefore, how to make the frequency range for the antenna to receive/send signals consistent with that of the mobile phone after a size reduction has become another important topic.

SUMMARY OF THE INVENTION

The present invention is directed to an antenna structure with a simplified and delicate structure, which is suitable for being embedded in a light and thin electronic device.

The present invention is also directed to an antenna structure capable of receiving/sending signals consistent with a common frequency range of an existing mobile phone.

In accordance with the aforementioned objectives, the present invention provides an antenna structure suitable for being embedded in an electronic device. The antenna structure is made and formed by cutting and bending a metal sheet. The antenna structure comprises a grounding plate, a radiating plate, and a shorting plate. The grounding plate has a body and a bending portion extending from the body. The radiating plate is disposed above the grounding plate and extended with an auxiliary radiating plate. The gap between the bending portion and the radiating plate is less than that between the body and the radiating plate. In addition, one end of the shorting plate is connected to the grounding plate, and the other end of the shorting plate is connected to the radiating plate.

In an embodiment of the present invention, the grounding plate is parallel with the radiating plate, the shorting plate is perpendicular to the grounding plate and the radiating plate.

In an embodiment of the present invention, the body has a first side edge and a second side edge opposite to the first side edge, and the radiating plate has a third side edge and a fourth side edge opposite to the third side edge. The shorting plate is connected between the first side edge and the third side edge.

In an embodiment of the present invention, the bending portion extends from the first side edge of the body.

In an embodiment of the present invention, the shorting plate has a first slot that is adjacent to the third side edge of the radiating plate.

In an embodiment of the present invention, the first slot has a width of 23 mm.

In an embodiment of the present invention, the antenna structure further comprises an auxiliary radiating plate connected to the fourth side edge of the radiating plate.

In an embodiment of the present invention, the auxiliary radiating plate is perpendicular to the radiating plate.

In an embodiment of the present invention, the auxiliary radiating plate and the radiating plate are integrally formed.

In an embodiment of the present invention, the auxiliary radiating plate comprises a second slot adjacent to the fourth side edge of the radiating plate.

In an embodiment of the present invention, the second slot has a width of 50 mm.

In an embodiment of the present invention, the auxiliary radiating plate further comprises a third slot disposed at one side of the second slot.

In an embodiment of the present invention, the third slot has a width of 27 mm.

In an embodiment of the present invention, the antenna structure further comprises a feed line, and the bending portion has a first plane and a second plane opposite to the first plane, wherein the first plane faces the radiating plate, and the feed line is disposed on the second plane.

In an embodiment of the present invention, the shorting plate further comprises a feed point, wherein one end of the feed line is connected to the feed point, and the other end of the feed line is connected to a signal source.

In an embodiment of the present invention, the antenna structure receives/sends signals within a frequency range of 880-960 MHz and a frequency range of 1710-2170 MHz.

In an embodiment of the present invention, the grounding plate has a length of 55 mm and a width of 5 mm.

In an embodiment of the present invention, the radiating plate has a length of 55 mm and a width of 5 mm.

In an embodiment of the present invention, the gap between grounding plate and the radiating plate is 6 mm.

In an embodiment of the present invention, the bending portion has a length of 18 mm.

In an embodiment of the present invention, the bending portion extends from the body towards the radiating plate to a predetermined height and then extends parallel to the radiating plate to a predetermined distance, wherein the height is 2 mm.

Based upon the above, in the antenna structure of the present invention, the grounding plate has a bending portion. By fine adjusting the gap between the bending portion and the radiating plate, the frequency range for receiving/sending signals of the antenna structure in the present invention can be fine adjusted, so as to correct the deviation of the frequency range caused by the assembling process.

Particularly, the feed line of the present invention is disposed below the bending portion, and the bending portion has the function of fixing the feed line. Furthermore, the bending portion of the present invention may shield electromagnetic waves generated by the feed line, so as to prevent the electromagnetic waves generated by the feed line from affecting the resonance effect between the grounding plate and the radiating plate.

In another aspect, the antenna structure of the present invention also may be provided with a plurality of slots. Users may fine adjust the frequency range for the antenna structure to receive/send signals by fine adjusting the widths and/or lengths of the slots, so as to correct the deviation of the frequency caused by the assembling process.

In view of the above, the antenna structure of the present invention may be embedded in a light and thin electronic device and may efficiently receive/send signals within the frequency range that is consistent with the frequency range of a mobile phone, thereby enhancing the convenience in use.

In order to make the aforementioned and other objects, features and advantages of the present invention comprehensible, preferred embodiments accompanied with, figures are described in detail below.

It is to be understood that both the foregoing general description and the following detailed description are exemplary, and are intended to provide further explanation of the invention as claimed.

DESCRIPTION OF EMBODIMENTS

Figure 1:
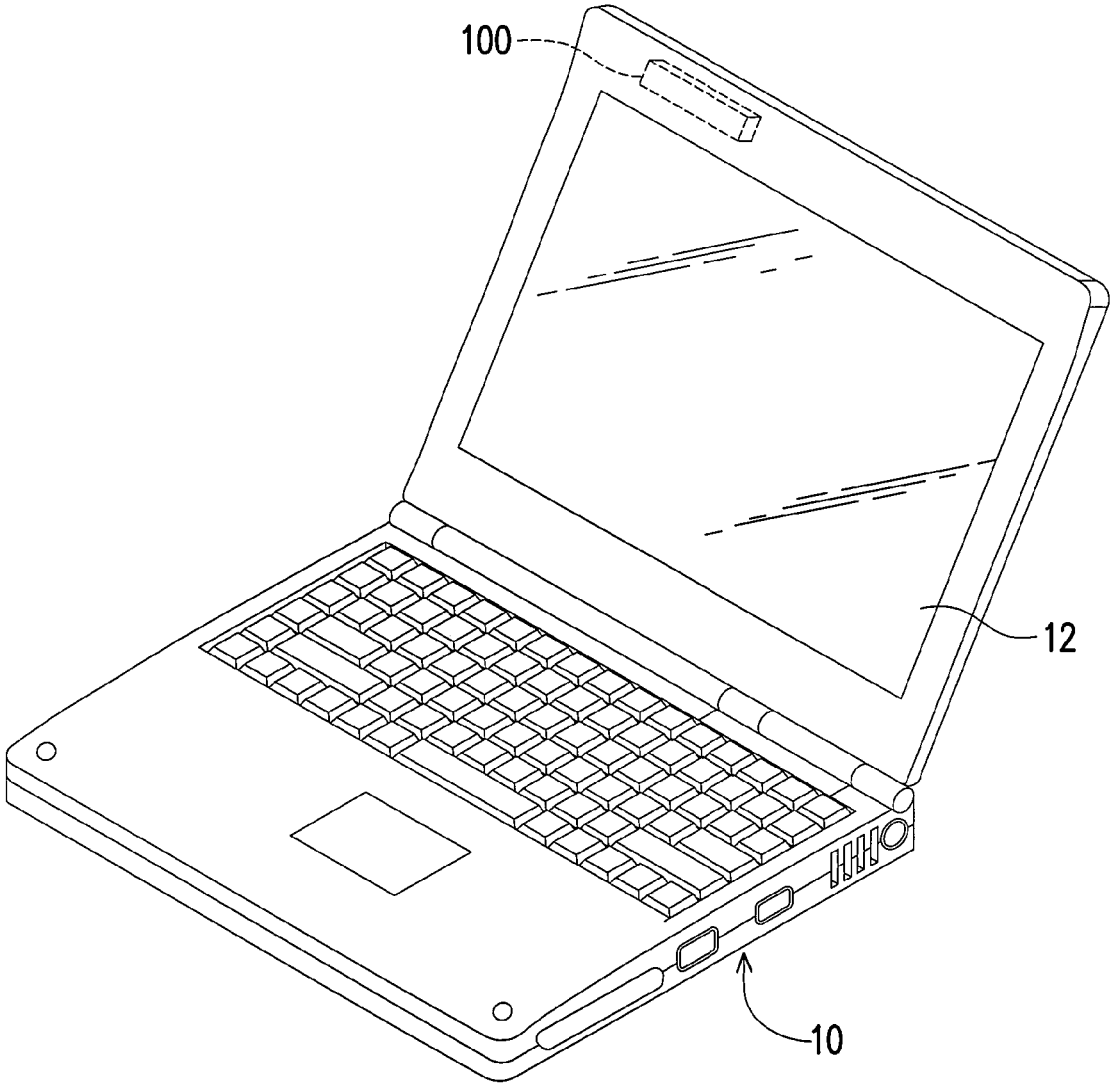
FIG. 1 is a schematic view of an antenna structure that is used for receiving/sending mobile phone signals and embedded in a notebook according to a preferred embodiment of the present invention.

Upon requirements in use, currently, besides an antenna for receiving network signals (the frequency ranges for such an antenna to receive network signals are 2.4 GHz-2.5 GHz and 4.9 GHz-5.9 GHz), an antenna for receiving/sending mobile phone signals is further provided in a notebook. FIG. 1 is a schematic view of an antenna structure that is used for receiving/sending mobile phone signals and embedded in a notebook according to a preferred embodiment of the present invention. As can be seen from FIG. 1, the antenna structure 100 of the present invention is, for example, disposed above a display module 12 of a notebook computer 10, so as to efficiently receive/send mobile phone signals. The antenna structure 100 of the present invention not only receives/sends signals within the frequency range of 900 MHz, 1800 MHz, and 1900 MHz of a common 3 G mobile phone, but also signals within the frequency range of 2000-2100 MHz, i.e., the antenna structure 100 of the present invention receives/sends signals within a frequency range of a 4 G mobile phone. Particularly, the antenna structure 100 of the present invention is a plane inverted F-shaped antenna (PIFA), which can receive/send mobile phone signals falling in the frequency ranges of 880-960 MHz and 1710-2170 MHz. The antenna structure of the present invention will be described in detail below.

Figure 2A:
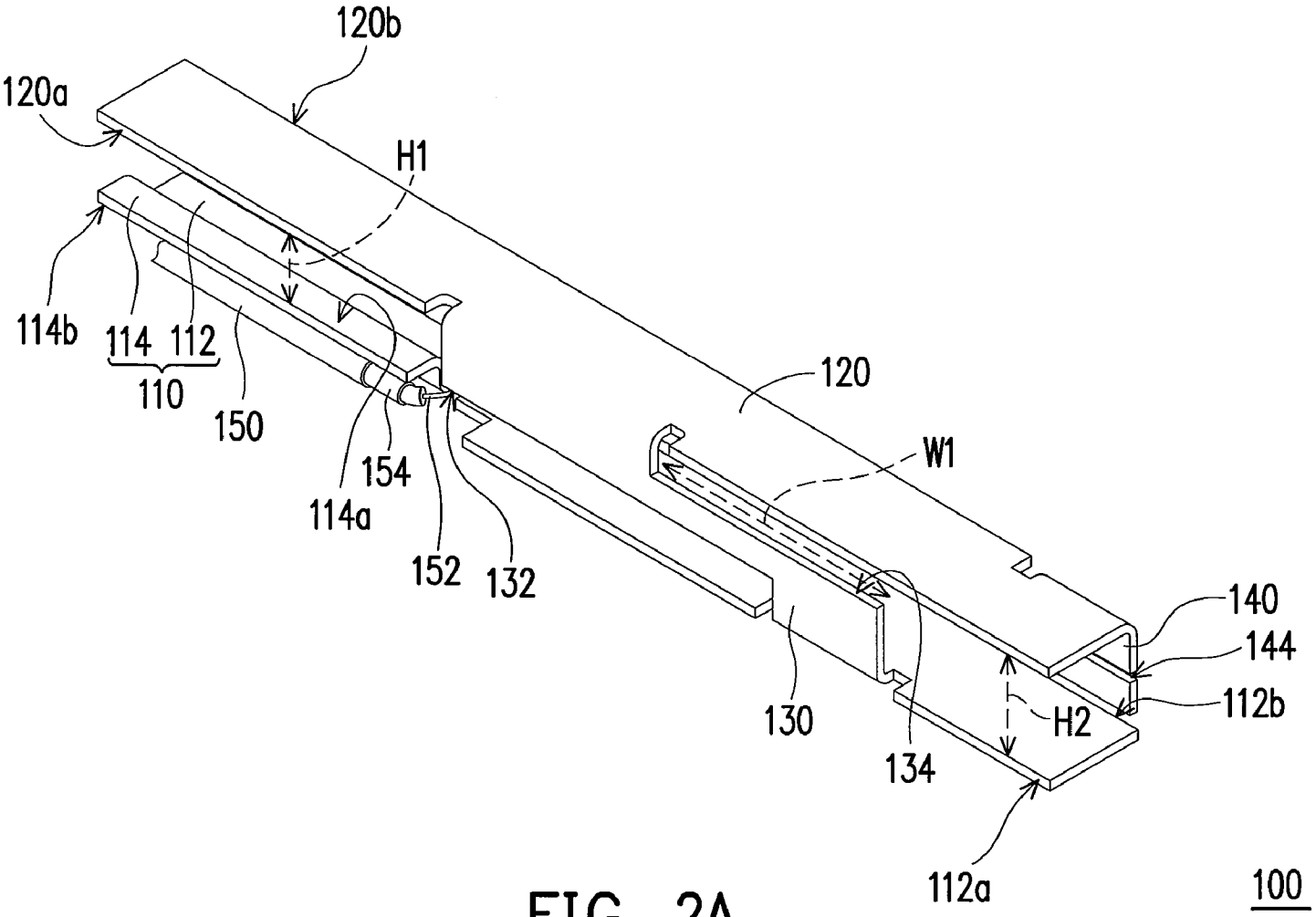
FIG. 2A is a stereogram of an antenna structure according to a preferred embodiment of the present invention.

FIG. 2A is a stereogram of an antenna structure according to a preferred embodiment of the present invention. Referring to FIG. 2A, the antenna structure 100 in this embodiment is made and formed by cutting and bending a metal sheet. The antenna structure 100 includes a grounding plate 110, a radiating plate 120, and a shorting plate 130. The grounding plate 110 of this embodiment is, for example, a grounding metal sheet, wherein the grounding plate 110 has a length of, for example, 55 mm and a width of, for example, 5 mm. The grounding plate 110 has a body 112 and a bending portion 114 extending from the body 112, wherein the bending portion 114 has a length of, for example, 18 mm. The radiating plate 120 is, for example, a metal sheet, and disposed above the grounding plate 110, wherein the grounding plate 110 is, for example, parallel with the radiating plate 120. The gap H1 between the bending portion 114 and the radiating plate 120 is less than the gap H2 between the body 112 and the radiating plate 120, wherein the gap between the grounding plate 110 and the radiating plate 120 is, for example, 6 mm. Furthermore, the shorting plate 130 is, for example, a metal sheet. One end of the shorting plate 130 is connected to the grounding plate 110 and the other end is connected to the radiating plate 120. In this embodiment, the shorting plate 130 is, for example, perpendicular to the grounding plate 110 and the radiating plate 120 respectively.

In view of the above, the body 112 of the grounding plate 110 has, for example, a first side edge 112*a* and a second side edge 112*b* opposite to the first side edge 112*a*. The radiating plate 120 has, for example, a third side edge 120*a* and a fourth side edge 120*b* opposite to the third side edge 120*a*. The shorting plate 130 is connected between the first side edge 112*a* and the third side edge 120*a*. Additionally, the bending portion 114, for example, extends from the first side edge 112*a* of the body 112. The bending portion 114 of this embodiment extends from the body 112 towards the radiating plate 120 to a predetermined height (for example, 2 mm), and then extends parallel to the radiating plate 120 to a predetermined distance, and then, is bent into a step-like shape with an approximately right angle. The bending portion 114 has a first plane 114*a* and a second plane 114*b* opposite to the first plane 114*a*, wherein the first plane 114*a* faces the radiating plate 120.

In this embodiment, the antenna structure 100 further includes a feed line 150 disposed on the second plane 114*b*, and the feed line 150 may be fixed on the second plane 114*b* of the bending portion 114. One end of the feed line 150 is, for example, connected to a feed point 132 on the shorting plate 130, and the other end is connected to a signal source (not shown). Therefore, a signal is fed from the signal source to the shorting plate 130 via the feed line 150, and then, the signal is sent out in the form of electromagnetic waves via the radiating plate 120 (or the shorting plate 130). In this embodiment, where the feed line 150 is, for example, a coaxial cable, a portion 152 serving as a core conductor of the signal transmission is connected to the feed point 132, and a portion 154 serving as a peripheral conductor of the signal shield is connected to, for example, the bending portion 114 of the grounding plate, 110. It should be noted that, since the feed line 150 is disposed on the second plane 114*b* (i.e., nothing is between the bending portion 114 and the radiating plate 120), when the antenna structure 100 is in the operating mode, the bending portion 114 may shield the electromagnetic waves generated by the feed line 150, such that a desirable resonance effect may be achieved between the bending portion 114 (or the grounding plate 110) and the radiating plate 120. Therefore, the antenna structure 100 achieves a preferable signal receiving/sending quality.

Referring to FIG. 2A, in this embodiment, the shorting plate 130 has a first slot 134 with the width of, for example, 23 mm, wherein the first slot 134 is adjacent to the third side edge 120*a* of the radiating plate 120. The design (the size and shape) of the first slot 134 enables the antenna structure 100 to receive/send mobile phone signals within the frequency range of 880-960 MHz. In a preferred embodiment, the width W1 of the first slot 134 is fine adjusted to more efficiently fine adjust the frequency range for the antenna structure 100 to receive/send mobile phone signals.

Figure 2B:
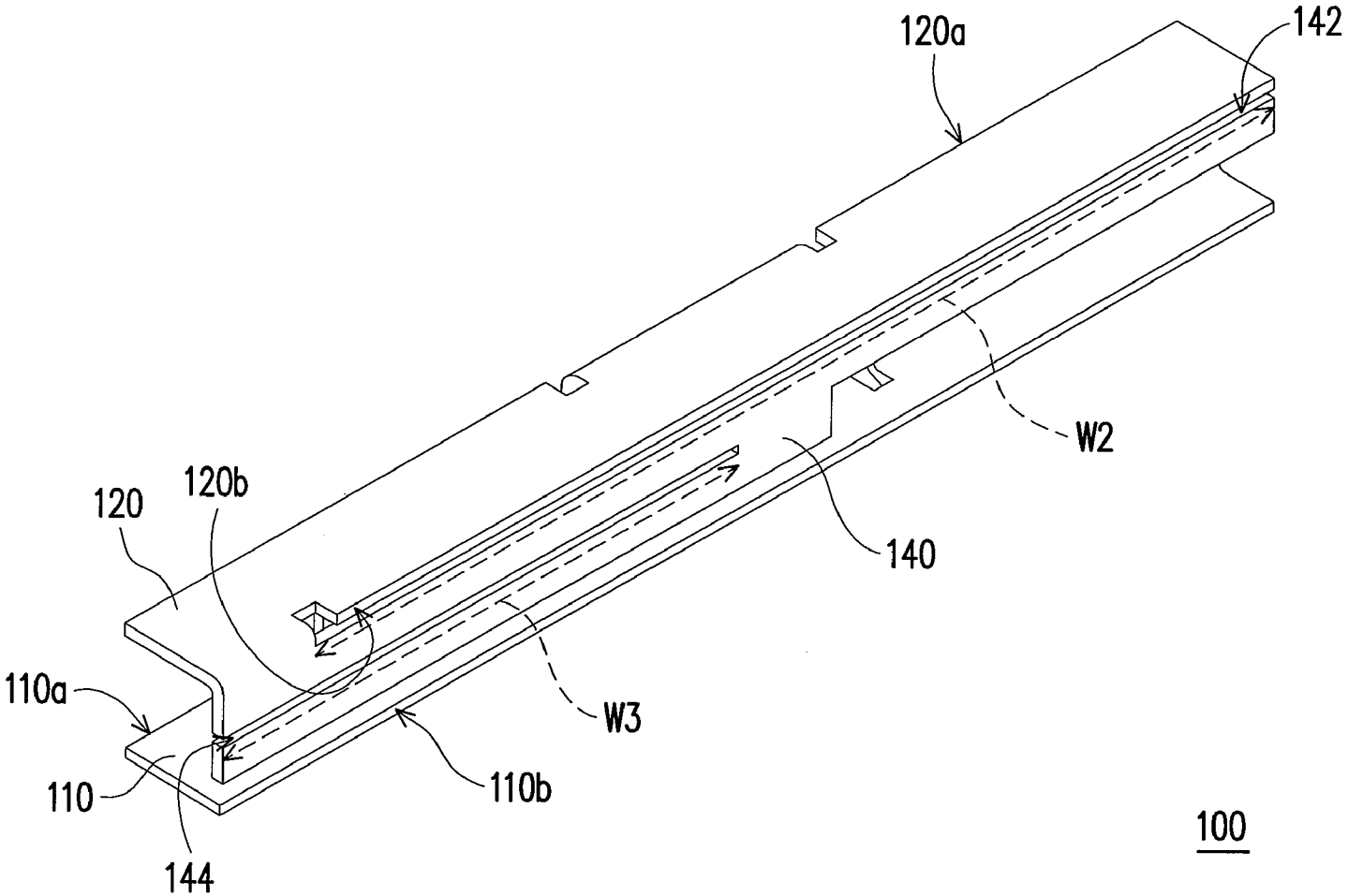
FIG. 2B is a stereogram of the antenna structure in FIG. 2A when viewed from another viewing angle.

FIG. 2B is a stereogram of the antenna structure in FIG. 2A from another viewing angle. Referring to FIG. 2B, in this embodiment, the antenna structure 100 further includes an auxiliary radiating plate 140 connected to the fourth side edge 120*b* of the radiating plate 120. As can be seen from FIG. 2B that, the auxiliary radiating plate 140 in this embodiment is, for example, perpendicular to the radiating plate 120. The auxiliary radiating plate 140 is, for example, bent from the radiating plate 120. That is, the auxiliary radiating plate 140 and the radiating plate 120 are integrally formed.

In a preferred embodiment, the auxiliary radiating plate 140 has a second slot 142 and a third slot 144 disposed therein, wherein the width of the second slot 142 is, for example, 50 mm, and the width of the third slot 144 is, for example, 27 mm. The second slot 142 is adjacent to the fourth side edge 120*b* of the radiating plate 120, and the third slot 144 is disposed at one side of the second slot 142. The arrangement of the second slot 142 enables the antenna structure 100 to receive/send signals at the frequency ranges of 880-960 MHz, 1800 MHz, and 1900 MHz, and the design of the third slot 144 enables the antenna structure 100 to receive/send signals within a frequency range of 2000-2100 MHz. In other words, the arrangement of the auxiliary radiating plate 140 enables the antenna structure 100 to receive/send signals within the frequency range of a 4 G mobile phone. Of course, in this embodiment, the widths W2 and W3 of the second slot 142 and the third slot 144 may be fine adjusted to enable the antenna structure 100 to more efficiently fine adjust the frequency range for receiving/sending signals. Furthermore, the signal fed into the shorting plate 130 via the feed line 150 (shown in FIG. 2A), can also be sent out in the form of electromagnetic waves via the auxiliary radiating plate 140.

It should be noted that, in order to allow the antenna structure 100 to have a small size, and meanwhile, maintain the frequency range for the antenna structure to receive/send signals, in this embodiment, the gap H1 (shown in FIG. 2A) between the bending portion 114 and the radiating plate 120 is fined adjusted to further fine adjust the frequency range for the antenna structure 100 to receive/send signals, so as to correct the deviation of the frequency range caused by the assembling process or other factors. In this embodiment, the size of the antenna structure 100 may be, for example, reduced to be 55 mm×5 mm×6 mm, and the frequency range for receiving/sending signals is also consistent with the frequency ranges (880-960 MHz and 1710-2170 MHz) of a current mobile phone. Furthermore, the antenna structure 100 may be embedded in a notebook or another mobile communication device.

Figure 3:
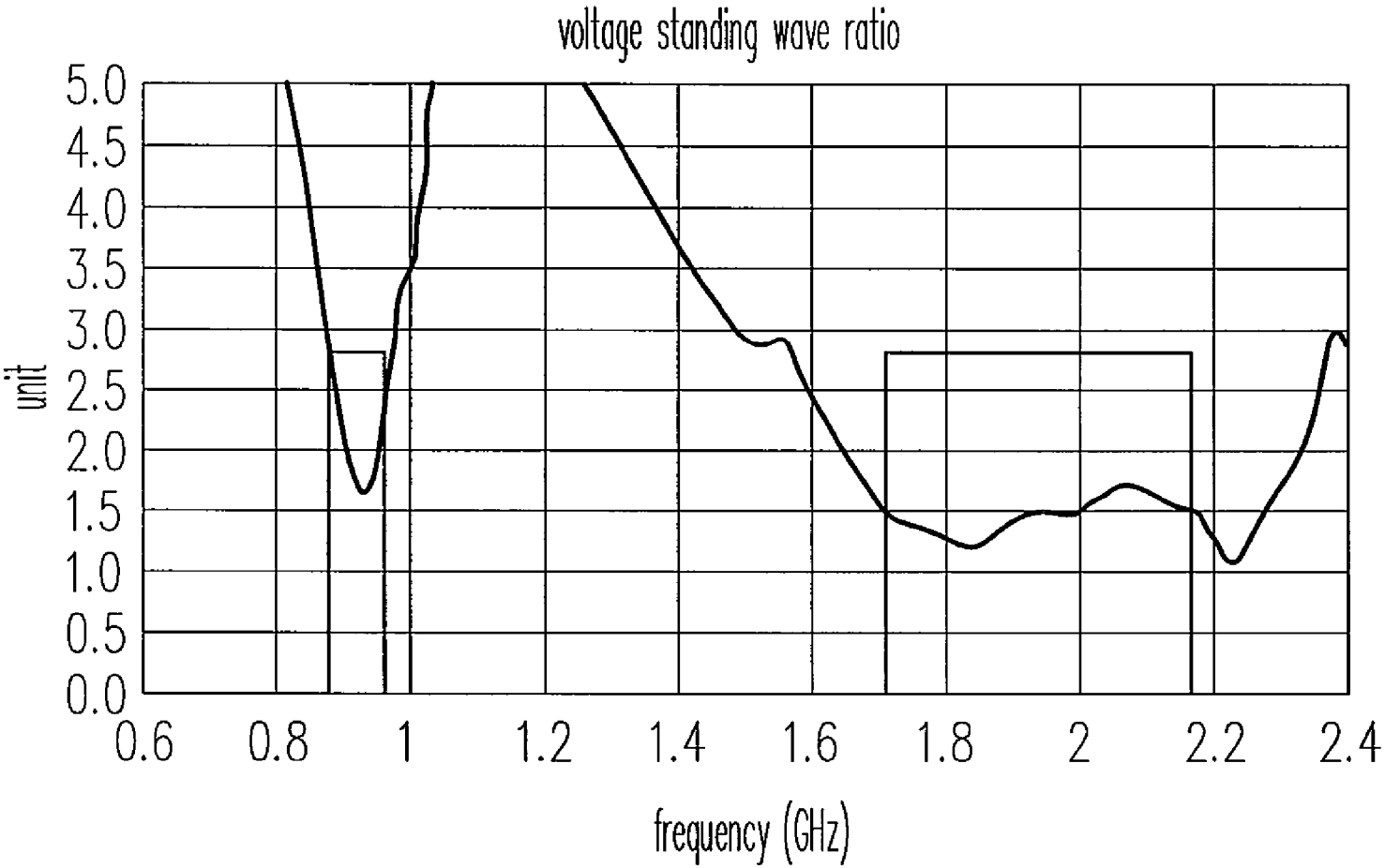
FIG. 3 is a function graph of the frequency to the voltage standing wave ratio of the antenna structure of the present invention.

FIG. 3 is a functional graph of the frequency to the voltage standing wave ratio (VSWR) of the antenna structure of the present invention. As shown in FIG. 3, when the VSWR is slightly smaller than, for example, 2.8, the frequency range for the antenna structure 100 in this embodiment to receive/send signals falls within two periods of 880-960 MHz (0.88-0.96 GHz) and 1710-2170 MHz (1.71-2.17 GHz). A perfect decreasing amplitude occurs in both intervals, which indicates that in the two intervals, the antenna structure of the present invention have perfect performance in receiving/sending signals, and has a frequency range that is consistent with that of the mobile phone.

In view of the above, the frequency range of the antenna structure in the present invention for receiving/sending signals is consistent with the frequency range of the mobile phone, and the frequency range of the antenna structure for receiving/sending signals is further fine adjusted by fine adjusting the gap between the bending portion and the radiating plate, and the width and/or lengths of the slot in the metal sheet. Therefore, even if the size of the antenna structure is reduced, those skilled in the art may also make the frequency range for the antenna structure to receive/send signals be consistent with the frequency range of the mobile phone by using the aforementioned adjusting method. Furthermore, the bending portion of the present invention is used to both fix the feed line and shield the electromagnetic waves generated by the feed line. Compared with the conventional art, the present invention has the following advantages.

(1) Due to the simplified configuration and the small size, the antenna structure of the present invention is suitable for being embedded in a light and thin and tiny electronic device.

(2) The external dimensions, shapes of the elements of the antenna structure of the present invention, such as the grounding plate, the radiating plate, the shorting plate, the auxiliary radiating plate and the bending plate, and specifications, such as the widths W1, W2, and W3 and the gaps H1 and H2 of each slot, all can be fine adjusted to correct the deviation of the frequency range caused by the assembling process or other factors, so as to ensure that the frequency range for the antenna structure to receive/send signals both meets the frequency range requirements of the nowadays mainstream mobile phone and 4 G mobile phone in future.

(3) The bending portion of the present invention is used to fix the feed line and shield the electromagnetic waves generated by the feed line, such that the antenna structure of the present invention has a preferable and steady quality in receiving/sending signals.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An antenna structure, suitable for being embedded in an electronic device, comprising:

a grounding plate, having a body and a bending portion extending from a first side edge of the body;

a radiating plate, disposed above the grounding plate, wherein a gap between the bending portion and the radiating plate is less than that between the body and radiating plate; and a shorting plate, with one end connected to the first side edge of the body of the grounding plate and another end connected to the radiating plate, wherein the shorting plate has a feed point electrically connected to a feed line;

wherein one end of the feed line is connected to the feed point, and another end of the feed line is connected to a signal source, the bending portion is located between the feed line and the radiating plate for preventing a resonance effect between the grounding plate and the radiating plate from being affected by electromagnetic waves generated by the feed line.

2. The antenna structure as claimed in claim 1, wherein the grounding plate is parallel to the radiating plate, and the shorting plate is perpendicular to the grounding plate and the radiating plate.

3. The antenna structure as claimed in claim 1, wherein the body has a second side edge opposite to the first side edge, the radiating plate has a third side edge and a fourth side edge opposite to the third side edge, and the shorting plate is connected between the first side edge and the third side edge.

4. The antenna structure as claimed in claim 3, wherein the shorting plate has a first slot adjacent to the third side edge of the radiating plate.

5. The antenna structure as claimed in claim 3, further comprising an auxiliary radiating plate connected to the fourth side edge of the radiating plate.

6. The antenna structure as claimed in claim 5, wherein the auxiliary radiating plate is perpendicular to the radiating plate.

7. The antenna structure as claimed in claim 5, wherein the auxiliary radiating plate and the radiating plate are integrally formed.

8. The antenna structure as claimed in claim 5, wherein the auxiliary radiating plate comprises a second slot adjacent to the fourth side edge of the radiating plate.

9. The antenna structure as claimed in claim 8, wherein the auxiliary radiating plate further comprises a third slot disposed at one side of the second slot.

10. The antenna structure as claimed in claim 1, wherein the bending portion has a first plane and a second plane opposite to the first plane, the first plane faces the radiating plate, and the feed line is disposed on the second plane.

11. The antenna structure as claimed in claim 1, wherein the antenna structure receives/sends signals at a frequency range of 880-960 MHz and a frequency range of 1710-2170 MHz.

12. The antenna structure as claimed in claim 1, wherein the grounding plate has a length of 55 mm and a width of 5 mm.

13. The antenna structure as claimed in claim 1, wherein the radiating plate has a length of 55 mm and a width of 5 mm.

14. The antenna structure as claimed in claim 1, wherein the bending portion extends from the body towards the radiating plate to a predetermined height and then extends parallel to the radiating plate to a predetermined distance.

* * * * *